US006558249B1

(12) United States Patent
Anderson

(10) Patent No.: US 6,558,249 B1
(45) Date of Patent: May 6, 2003

(54) AIR DIFFUSER FABRIC AND AIR DIFFUSERS FORMED THEREFROM

(76) Inventor: Jerry C. Anderson, 318 Point Pl., Chicasaw Point, Westminster, SC (US) 29693

( * ) Notice: Subject to any disclaimer, the term of this patent is extended or adjusted under 35 U.S.C. 154(b) by 0 days.

(21) Appl. No.: 09/597,327

(22) Filed: Jun. 19, 2000

(51) Int. Cl.[7] ..... F24F 7/00
(52) U.S. Cl. ..... 454/306
(58) Field of Search ..... 454/903, 270, 454/284, 306

(56) References Cited

U.S. PATENT DOCUMENTS 4,054,710 A 10/1977 Botsolas
4,452,848 A 6/1984 Geiger
4,537,116 A * 8/1985 Nassof ..... 454/297
5,147,242 A * 9/1992 Lowe, Jr. ..... 454/63
5,655,963 A * 8/1997 Paschke et al. ..... 454/297
5,769,708 A * 6/1998 Paschke et al. ..... 454/306
5,965,257 A * 8/1999 Ahluwalia ..... 428/357
6,253,777 B1 7/2001 Anderson

* cited by examiner

*Primary Examiner*—Harold Joyce
*Assistant Examiner*—Derek S. Boles

(57) ABSTRACT

A air diffuser fabric made from a fabric containing generally fire resistant fibers is provided. In particular, the air diffuser fabric is made from fire resistant polyester fibers. In one embodiment, the air diffuser is tubular-shaped and has a plurality of pores so that air can be distributed to the surrounding environment in a relatively non-disturbing manner.

23 Claims, 1 Drawing Sheet

AIR DIFFUSER FABRIC AND AIR DIFFUSERS FORMED THEREFROM

BACKGROUND OF THE INVENTION

Air diffusers are generally used in a variety of applications, such as in heating, cooling, filtration, and other systems. For example, air diffuser tubes can be hung from the ceilings of a facility to heat or cool the facility. In particular, air is first forced through one end of the air diffuser. As it flows through the air diffuser, air is distributed to the surrounding environment through holes or pores located on the outer surfaces of the diffuser tube. In this manner, hot or cold air can be supplied to the environment for temperature control purposes.

In most applications, it is desired that such air diffusers be lightweight and flame retardant. For example, some conventional air diffusers are made from cotton that is treated with a flame retardant coating. However, one problem associated with such air diffusers is that the flame retardant coating tends to wear off of the diffuser after a relatively short period of time. Moreover, conventional air diffusers often have relatively large hole or pore sizes. As a result, relatively large volumes of air are distributed through the large holes during use. Such large volumes of air can cause physical disturbances (i.e., blowing of air on an object) in the surrounding environment, which is often undesired, particularly in delicate environments. Moreover, larger particles, such as dust particles, can also be distributed through the large holes and adversely disrupt certain environments.

As such, a need currently exists for an improved air diffuser. In particular, a need exists for an air diffuser that is generally fire resistant and does not create physical disturbances when distributing air to the surrounding environment.

SUMMARY OF THE INVENTION

The present invention recognizes and addresses the foregoing disadvantages, and others of prior art constructions and methods. Accordingly, the present invention is generally directed to an air diffuser for distributing air to a surrounding environment. In one embodiment, the air diffuser is made from an air diffuser fabric containing generally fire resistant polyester fibers.

In general, an air diffuser of the present invention can contain a air-diffusing portion that defines a channel having a plurality of pores for the flow of air. The air-diffusing portion can have any shape and/or size desired. For instance, in one embodiment, the air-diffusing portion is tubular shaped. Moreover, one or more branch portions that extend from the air-diffusing portion can also be provided to distribute air to other areas.

As stated, air diffusers of the present invention are typically made from a fabric material. In particular, the air diffuser fabric can be formed from polyester yarns that are generally fire resistant. In one embodiment, for example, the air diffuser is formed from a fabric containing a polyester filament produced by Kosa known as AVORA FR Fibers. AVORA FR fibers are made from a fire resistant polyester that contains an organic phosphorus compound in the polyethylene terephthalate chain.

The yarns forming the air diffuser fabric can generally have a variety of deniers. For example, the yarns can have a denier between about 70 and about 1,200, and particularly between about 100 to about 300. Moreover, the air diffuser fabrics also typically have a basis weight between about 1.5 to about 12 ounces per square yard (oz/yd$^2$), and particularly between about 7.0 to 7.5 oz/yd$^2$. In addition, an air diffuser fabric of the present invention generally has a permeability of at least about 5 cubic feet per minute (as measured by the Frazier air permeability test), and particularly from about 10 to about 15 cubic feet per minute.

As stated above, an air diffuser fabric produced in accordance with the present invention is generally fire resistant. For example, an air diffuser fabric of the present invention can contain AVORA FR fibers that are generally fire resistant. Moreover, in contrast to conventional air diffusers, an air diffuser of the present invention can remain generally fire resistant for an extended period of time. In addition to being generally fire resistant, an air diffuser of the present invention can also distribute air in a relatively non-disturbing manner. Furthermore, an air diffuser of the present invention can also act as a filter for larger particles, such as dust particles, present within the air.

Various features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figures, in which.

Figure 1:
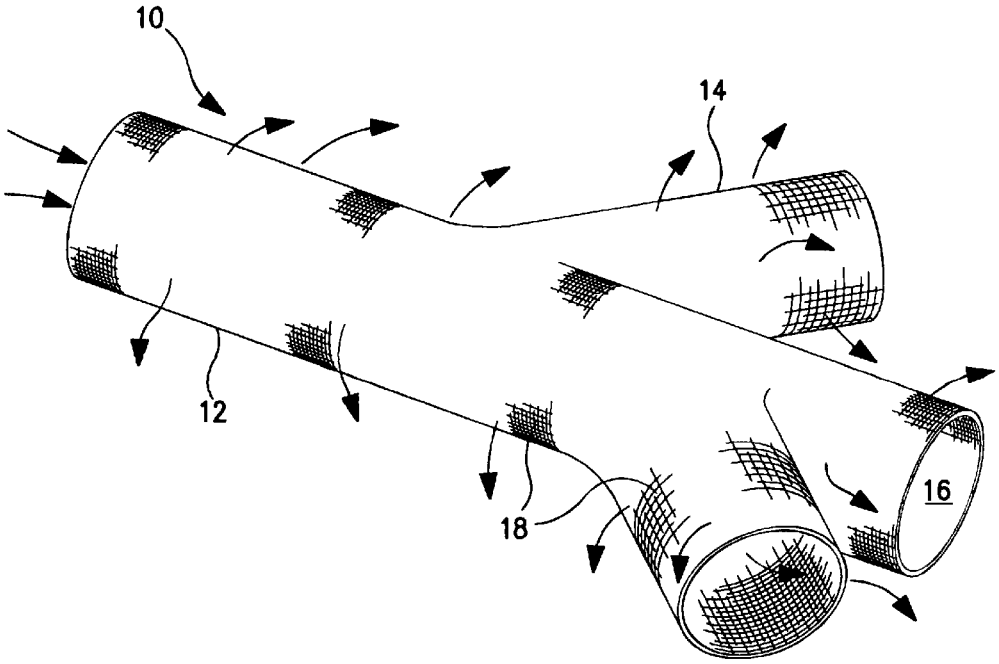
FIG. 1 is a perspective view of one embodiment of an air diffuser of the present invention.

Repeat use of reference characters in the present specification and drawings is intended to represent same or analogous features or elements of the invention.

DETAILED DESCRIPTION OF REPRESENTATIVE EMBODIMENTS

It is to be understood by one of ordinary skill in the art that the present discussion is a description of exemplary embodiments only, and is not intended as limiting the broader aspects of the present invention, which broader aspects are embodied in the exemplary construction.

In general, the present invention is directed to an air diffuser for distributing air to a surrounding environment. In one embodiment, the air diffuser is formed from a fabric. For instance, it has been discovered that by forming an air diffuser from a fabric in accordance with the present invention, the diffuser is generally fire resistant and can distribute air in a relatively non-disturbing manner.

Figure 2:
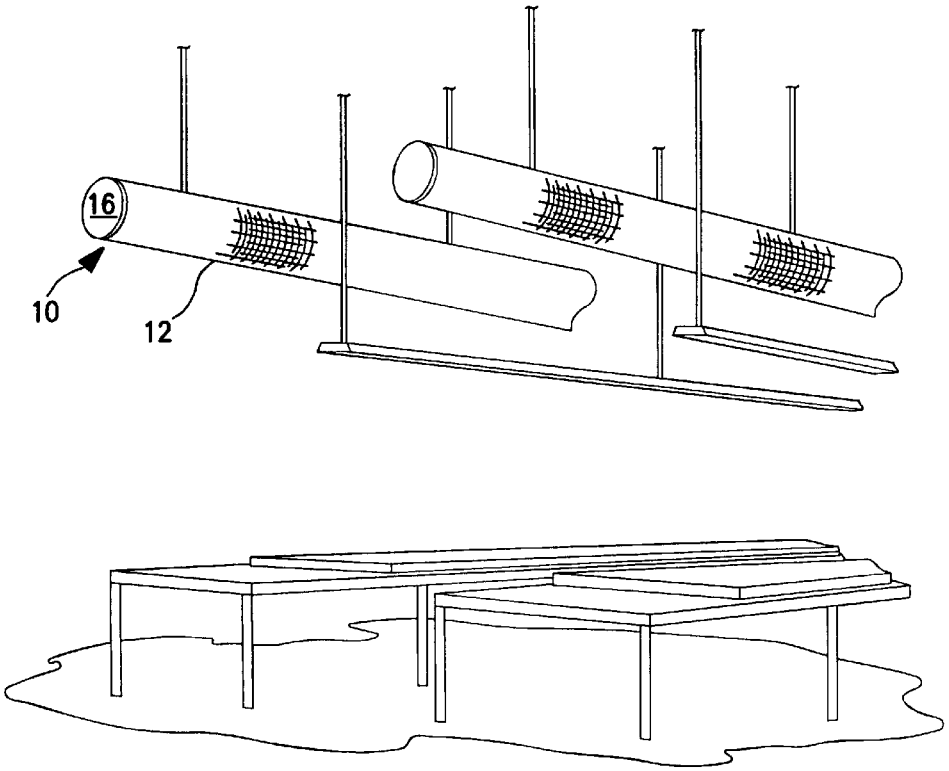
FIG. 2 is a perspective view of another embodiment of an air diffuser of the present invention.

Referring to FIGS. 1–2, one embodiment of an improved air diffuser 10 of the present invention that is expanded by pressurized air is illustrated. In general, air diffusers of the present invention can be used in a wide variety of other applications, such as in air conditioning systems, heating systems, air filtration systems, etc. As shown in FIG. 2, for example, air diffusers of the present invention can be utilized to heat or cool a manufacturing facility. It should be understood, however, that other embodiments are also anticipated and are intended to be covered by this invention.

To effectively distribute air to the surrounding environment, an air diffuser of the present invention can generally be made from one or more portions having any of a variety of shapes and/or sizes. In particular, depending on the particular application, one shape may be more suitable for a component of the air diffuser than other shapes. For example, as shown in FIGS. 1–2, the air diffuser 10 can, in some embodiments, contain an air-diffusing portion 12 that has a tubular shape. As indicated by the arrows in FIG. 1, such a tubular shape can readily allow the air-diffusing portion 12 to distribute air to the surrounding environment. In particular, as shown, the air-diffusing portion 12 defines a longitudinal channel 16 having a plurality of pores 18 for distributing air to the surrounding environment.

The air-diffusing portion 12 may also generally have any size desired. The precise diameter and length of the air-diffusing portion 12 will typically depend on the particular application and the volume of air required for distribution. For instance, in some HVAC applications, higher volumes of air may be required to cool or heat a facility. In such instances, the air-diffusing portion 12 can have a greater length and/or diameter to supply such volumes of air.

Further, in some instances, the air diffuser 10 can also contain other portions, such as one or more branch portions 14 extending from the air-diffusing portion 12. When utilized, the branch portion(s) 14 can allow air to be distributed to an increased area of the surrounding environment. For example, the air-diffusing portion 12 can distribute air to a certain area of a manufacturing facility, while the branch portion(s) 14 can distribute air to other areas of the facility. The branch portion(s) 14 may generally have any shape and/or size (e.g., diameter, length, etc.) desired. In one embodiment, for instance, the branch portion(s) 14 may have a tubular shape having the approximately the same diameter as the air-diffusing portion 12.

In general, air diffusers of the present invention are made from a fabric material. In particular, the air diffuser 10 can contain an airdiffusing portion 12 and optionally branch portion(s) 14, which are all made from a fabric. When utilized, the branch portion(s) can be made from the same or a different fabric than the portion 12. In one embodiment, for example, the fabric forming the air diffuser 10, including the air-diffusing portion 12 and the branch portion(s) 14, is formed from polyester yarns that are generally fire resistant. More particularly, in one embodiment of the present invention, the air diffuser 10 is a fabric made from yarns formed from a polyester filament produced by Kosa known as AVORA FR Type 692 FR Fiber. AVORA FR fibers are made from a flame resistant polyester that contains an organic phosphorus compound in the polyethylene terephthalate chain.

To produce an air diffuser fabric of the present invention, in one embodiment, the yarns are first generally unified. In particular, two strands of yarn made from continuous fiber filaments are unified by false twist texturizing. Generally, each strand of yarn can have a denier between about 70 and about 1,200, and particularly between about 100 to about 300. For instance, in one embodiment of the present invention, each strand of yarn made from AVORA FR fibers has a denier of about 150.

False twist texturizing first requires twisting the feeder yarn in the clockwise direction and subsequently twisting the feeder yarn in the counterclockwise direction. Furthermore, heat is applied to the feeder yarn during each twisting step to provide the yarn with memory, to heat-set the yarn, to draw the yarn, and to properly orient the molecular structure of the yarn. Generally, the amount of heat applied to the feeder yarn depends on the type of fiber used. Normally, it is desired that the temperature of the yarn not exceed its melting point. In one embodiment of the present invention, for example, the feeder yarn made from AVORA FR fibers can be heated to a temperature less than about 482° F., the melting point of the fibers.

Once the yarn is formed, the yarn is then woven or knitted into a fabric for use in accordance with the present invention. In general, the fabric formed from the yarn can have any suitable type of woven or knitted structure. Moreover, any type of weave can be utilized in the present invention. Some suitable types of weaves include, but are not limited to, basket, satin, twill, plain, Leno, and the like. For example, in one embodiment, a two-ply air diffuser fabric of the present invention is produced from 150-denier AVORA FR yarn with a 2×2 basket weave having approximately 97 ends/inch×68 picks/inch (length×width).

After forming the fabric, the fabric can then be scoured, although scouring may not be necessary for all applications. When utilized, scouring can partially stabilize the fabric by preventing residual shrinkage, as well as clean the fabric by removing water soluble lubricants used in yarn processing and fabric manufacturing that could, in some instances, cause inadequate fire resistance. In addition, the fabric can also be placed on a tenter frame to be dried and heat-set. Generally, heat-setting determines the finished width of the fabric by providing dimensional stability. Specifically, a fabric produced according to the present invention can be heat-set at a temperature between about 350° F. and about 375° F. for approximately one minute. In some embodiments, the fabric can also be calendered to increase the smoothness of the surfaces. Moreover, the air diffuser fabric may also be dyed to provide fabrics of varying color depending on the application. Generally, any dying method known to those of ordinary skill in the art can be used.

In general, the fabrics of the present invention can be made with various basis weights in order to optimize the properties of the fabric for any particular application. For instance, in some embodiments, the air diffuser fabric can have a basis weight between about 1.5 to about 12 ounces per square yard (oz/yd$^2$), and particularly between about 7.0 to 7.5 oz/yd$^2$. Moreover, an air diffuser fabric of the present invention also generally a permeability of at least about 5 cubic feet per minute (as measured by the Frazier air permeability test). In particular, the air diffuser fabric can have a permeability of about 10 to about 15 cubic feet per minute.

An air diffuser made from a fabric of the present invention, such as described above, is generally fire resistant. For example, as stated above, an air diffuser fabric containing AVORA FR yarn can be generally fire resistant, such as determined by the National Fire Protection Association Small Scale Flame Resistant Criteria (NFPA 701) and/or Fed. Test Method 5903. Moreover, in contrast to conventional air diffusers, an air diffuser of the present invention can remain generally fire resistant for an extended period of time.

In addition to being generally fire resistant, an air diffuser of the present invention can also distribute air in a relatively non-disturbing manner. In particular, an air diffuser fabric of the present invention distributes air through a plurality of small pores formed by the intersection of the yarns. As such, small volumes of air can be distributed through the small pores for cooling or heating without substantially physically disturbing the surrounding environment. Moreover, by having such relatively small pores, an air diffuser of the present invention can also act as a filter for larger particles, such as dust particles, present within the air being distributed.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. An air diffuser for distributing air to a surrounding environment comprising:

an air-diffusing fabric defining a channel comprising a plurality of pores in communication with said channel, said fabric comprising generally fire resistant polyester fibers, said fabric having a basis weight of about 1.5 ounces per square yard to about 12 ounces per square yard.

2. An air diffuser as defined in claim 1, wherein said fabric has a basis weight of about 7 ounces per square yard to about 7.5 ounces per square yard.

3. An air diffuser as defined in claim 1, wherein said fabric is made from yarns having a denier of from about 70 to about 1,200.

4. An air diffuser as defined in claim 1, wherein said fabric is made from yarns having a denier of about 100 to about 300.

5. An air diffuser as defined in claim 1, wherein said fabric is a woven fabric having a basket weave.

6. An air diffuser as defined in claim 1, wherein said fabric has a permeability of at least about 5 cubic feet per minute.

7. An air diffuser as defined in claim 1, wherein said fabric has a permeability of between about 10 cubic feet per minute to about 15 cubic feet per minute.

8. An air diffuser as defined in claim 1, wherein said fabric contains false twist texturized yarns.

9. An air diffuser as defined in claim 1, wherein said air-diffusing fabric is tubular-shaped.

10. air diffuser as defined in claim 1, further comprising at least one branch portion extending from said air-diffusing fabric.

11. An air diffuser for distributing air to a surrounding environment comprising:

a tubular-shaped air-diffusing fabric defining a longitudinal channel comprising a plurality of pores in communication with said longitudinal channel, said fabric comprising generally fire resistant polyester yarns, said yarns having a denier of from about 70 to about 1,200, said fabric having a basis weight of about 1.5 ounces per square yard to about 12 ounces per square yard and a permeability of at least about 5 cubic feet per minute.

12. An air diffuser as defined in claim 11, wherein said fabric has a basis weight of about 7 ounces per square yard to about 7.5 ounces per square yard.

13. An air diffuser as defined in claim 11, wherein said yarns have a denier of about 100 to about 300.

14. An air diffuser as defined in claim 11, wherein said fabric is a woven fabric having a basket weave.

15. An air diffuser as defined in claim 11, wherein said fabric has a permeability of between about 10 cubic feet per minute to about 15 cubic feet per minute.

16. An air diffuser as defined in claim 11, further comprising at least one branch portion extending from said air-diffusing fabric.

17. An air diffuser fabric comprising:

generally fire resistant polyester yarns having a denier of about 70 to about 1,200, said air diffuser fabric having a basis weight of about 1.5 ounces per square yard to about 12 ounces per square yard.

18. An air diffuser fabric as defined in claim 17, wherein said fabric has a basis weight of about 7 ounces per square yard to about 7.5 ounces per square yard.

19. An air diffuser fabric as defined in claim 17, wherein said yarns have a denier of about 100 to about 300.

20. An air diffuser fabric as defined in claim 17, wherein said fabric is a woven fabric having a basket weave.

21. An air diffuser fabric as defined in claim 17, wherein said fabric has a permeability of at least about 5 cubic feet per minute.

22. An air diffuser fabric as defined in claim 17, wherein said fabric has a permeability of between about 10 cubic feet per minute to about 15 cubic feet per minute.

23. An air diffuser fabric as defined in claim 17, wherein said yarns are false twist texturized.

* * * * *